US006119795A

United States Patent [19]

Lee

[11] Patent Number: 6,119,795

[45] Date of Patent: Sep. 19, 2000

[54] HYDRAULIC HAMMER HAVING IMPROVED SEAL RING

[75] Inventor: Gun-jik Lee, Incheon, Rep. of Korea

[73] Assignee: HyupSung Heavy Industries Co., Ltd., Incheon, Rep. of Korea

[21] Appl. No.: 09/095,454

[22] Filed: Jun. 10, 1998

[30] Foreign Application Priority Data

Jun. 11, 1997 [KR] Rep. of Korea ..... 97-24200

[51] Int. Cl.[7] ..... B25D 9/00

[52] U.S. Cl. ..... 173/114; 173/128; 173/138; 173/200; 173/213

[58] Field of Search ..... 173/132, 200, 173/114, 213, 218, 128

[56] References Cited

U.S. PATENT DOCUMENTS 4,109,734 8/1978 Montabert ..... 173/114
4,508,017 4/1985 Montabert ..... 173/200
5,129,466 7/1992 Bartels et al. ..... 173/200
5,370,194 12/1994 Anderson ..... 173/213

FOREIGN PATENT DOCUMENTS 9744030 7/1997 Rep. of Korea .

*Primary Examiner*—Scott A. Smith
*Attorney, Agent, or Firm*—Orum & Roth

[57] ABSTRACT

A hydraulic hammer having an improved seal ring contacting with a piston. The hydraulic hammer having a cylinder having an inner surface where a fluid groove connected to a passage for passing the fluid is formed, a piston installed in the cylinder to be elevated, and a first seal ring for guiding the elevation of the piston, installed in an inner surface of the cylinder under the fluid groove and contacting with the piston, includes one or more second seal rings having one or more grooves or holes for passing the fluid, installed on the fluid groove and/or between the fluid groove and the first seal ring. Accordingly, the length of use before replacement of the seal ring installed between the piston and the cylinder can be extended, to thereby reduce the cost for operating the hydraulic hammer.

3 Claims, 6 Drawing Sheets

HYDRAULIC HAMMER HAVING IMPROVED SEAL RING

BACKGROUND OF THE INVENTION

1. Field of the Invention

The present invention relates to a hydraulic hammer operated by hydraulic pressure, and more particularly, to a hydraulic hammer having an improved seal ring contacting a piston thereof.

2. Description of the Related Art

In general, a hydraulic hammer mounted on an apparatus such as an excavator or a loader having a hydraulic pump, raises and lowers a piston installed inside the hammer by controlling high pressure fluid supplied by a hydraulic pump through a predetermined passage and valve to cause a hammer action, which crushes boulders or concrete by its force. The hydraulic hammer is categorized into a high pressure type, a low pressure type and a gas pressure type depending on the method of raising and lowering the piston.

FIG. 1 shows a prior low pressure type hydraulic hammer and FIG. 2 is an enlarged section view of the portion A of FIG. 1. The hydraulic hammer includes an accumulator 10, a valve housing 20, a seal housing 30, a cylinder 40 and a front head 50. A spool 21 is installed in the valve housing 20, a piston 60 is installed in the cylinder 40 and a tool 51 is installed in the front head 50.

Referring to FIG. 2, first and second grooves 41 and 42 and a hydraulic groove 43 are formed on an inner surface of a lower portion of the cylinder 40. Here, a wiper 61 is inserted into the first groove 41, one seal ring 62 is installed in the second groove 41, and a passage 63 for passing a pressurized fluid is connected to the hydraulic groove 43. A seal ring 62 is formed of a non-metal, so that a piston 60 and a cylinder 40 which are formed of a metal can stably move up and down without contacting with each other, and the fluid passing between the cylinder 40 and the piston 60 is prevented from leaking outward. The wiper 61 prevents an external foreign material from entering between the piston 60 and the cylinder 40.

The length of use of the seal ring 62 is typically 6 months. After about 6 months, the piston 60 becomes scratched, and the seal ring 62 wears rapidly, thereby requiring replacement of the seal ring 62. In order to replace the seal ring, the hydraulic hammer must be taken apart into numerous pieces.

SUMMARY OF THE INVENTION

To solve the above problems, it is an objective of the present invention to provide a hydraulic hammer for extending useable life of a seal ring between a piston and a cylinder.

Accordingly, to achieve the above objective, there is provided a hydraulic hammer including a cylinder having an inner surface where a fluid groove connected to a passage for passing the fluid is formed, a piston installed in the cylinder to be elevated, and a first seal ring for guiding the elevation of the piston, installed in an inner surface of the cylinder under the fluid groove and contacting with the piston, comprising one or more second seal rings having one or more grooves or holes for passing the fluid, installed on the fluid groove and/or between the fluid groove and the first seal ring.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
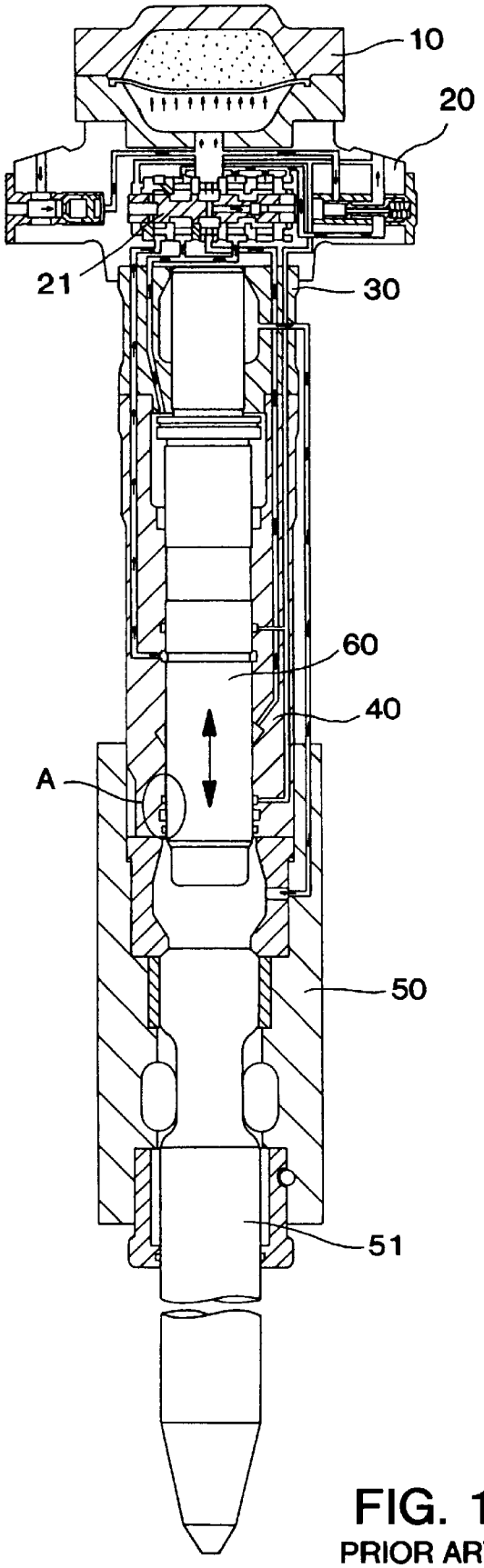
FIG. 1 PRIOR ART
FIG. 1 is a sectional view of a conventional hydraulic hammer.
Figure 2:
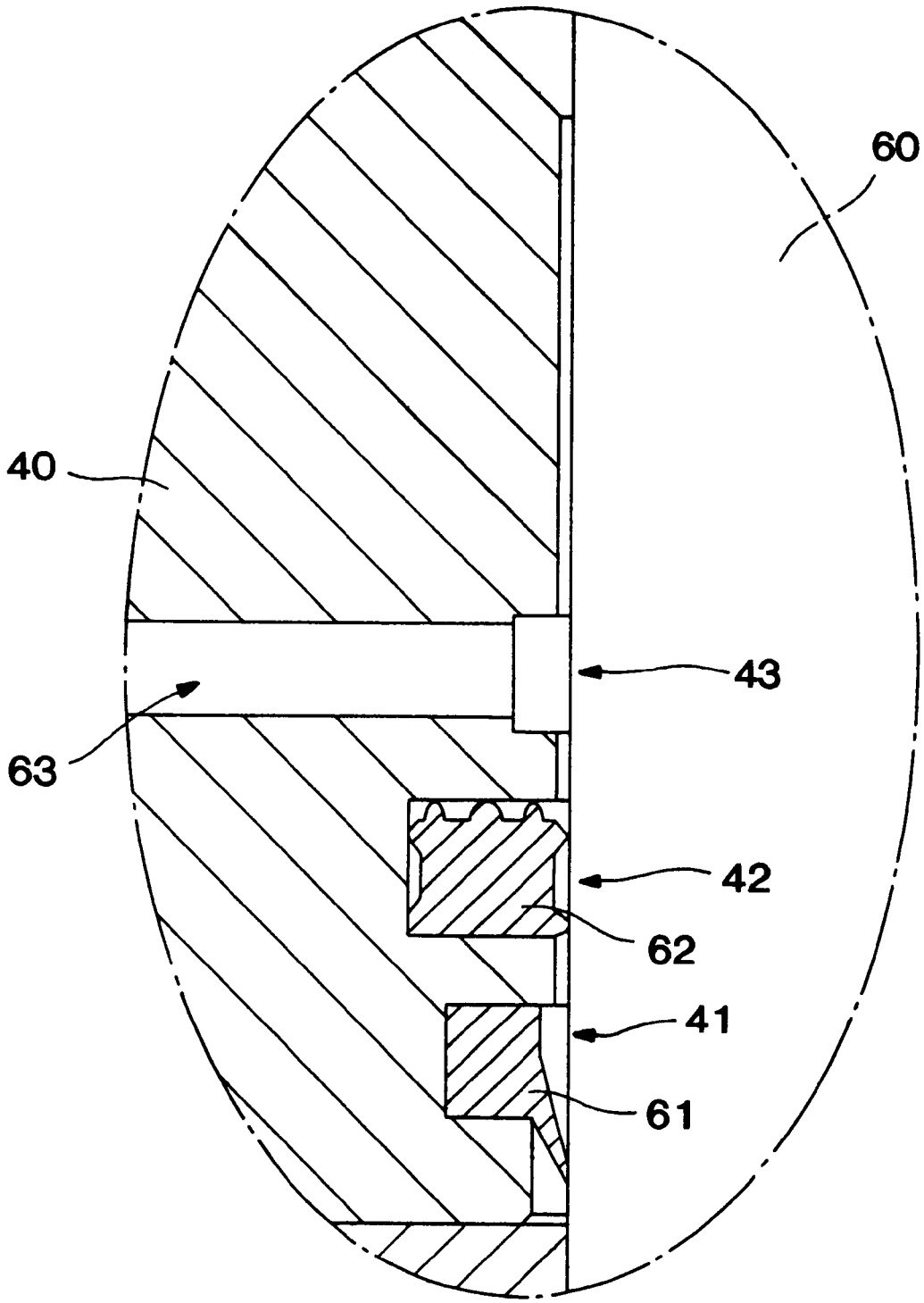
FIG. 2 PRIOR ART
FIG. 2 is an enlarged sectional view of the portion A of FIG. 1.
Figure 3:
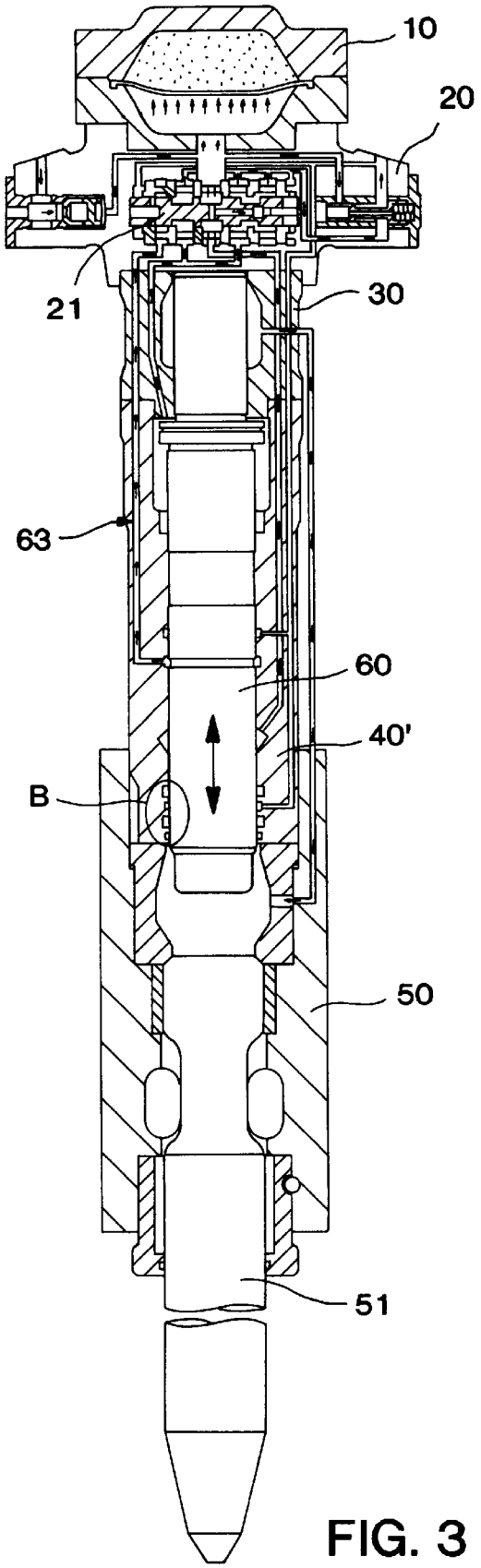
FIG. 3 is a sectional view of a hydraulic hammer according to the present invention.

FIG. 3 shows a low pressure hydraulic hammer. The hydraulic hammer includes an accumulator 10, a valve housing 20, a seal housing 30, a cylinder 40' and a front head 50. A spool 21 is installed in the valve housing 20, a piston 60 is installed in the cylinder 40' and a tool 51 is installed in the front head 50.

Figure 4:
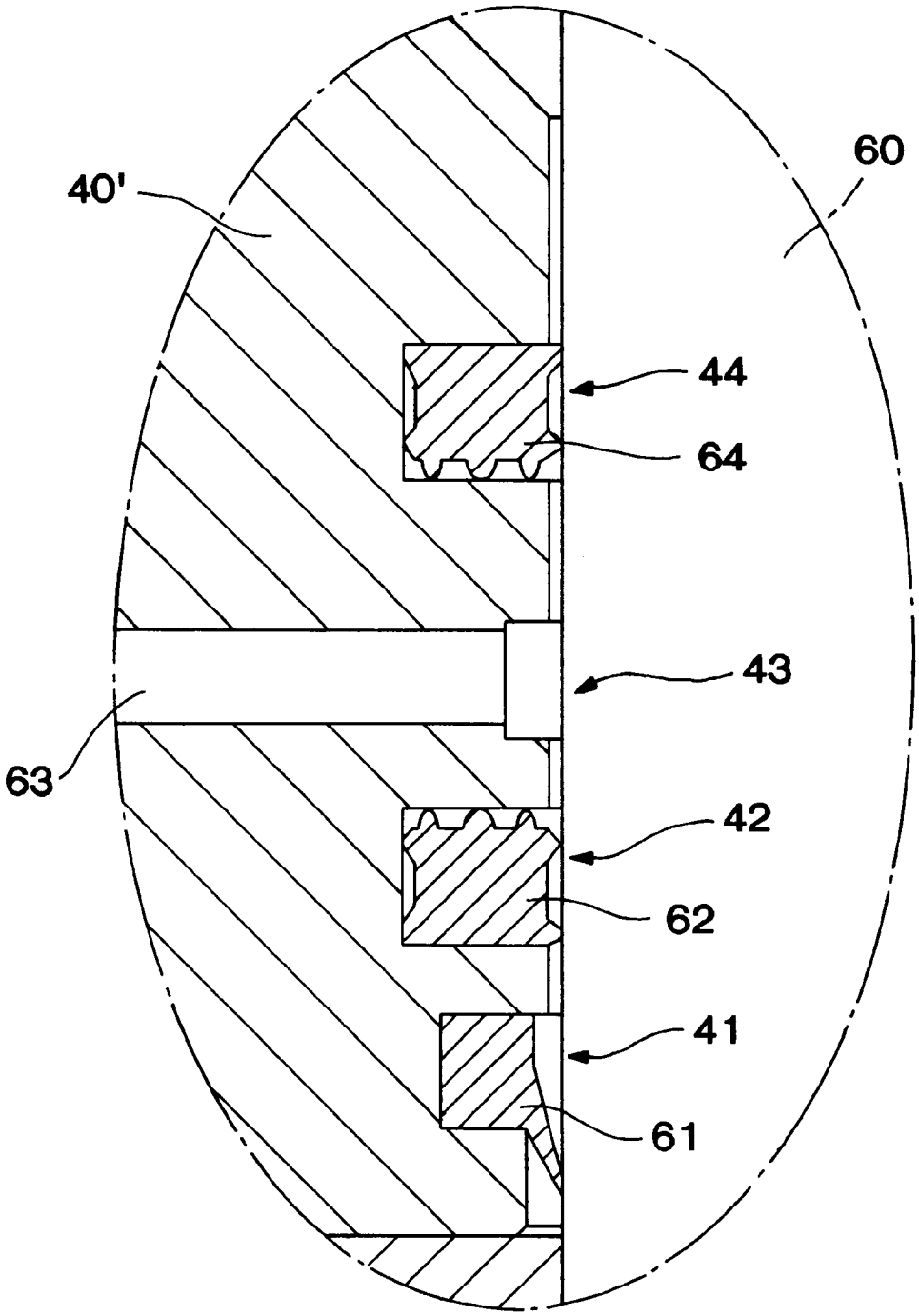
FIG. 4 is an enlarged sectional view of the portion B of FIG. 3.

Referring to FIG. 4, first, second and third grooves 41, 42 and 44 and a hydraulic groove 43 are formed on an inner surface of a lower portion of the cylinder 40'. Here, a wiper 61 is inserted into the first groove 41, the first seal ring 62 is installed in the second groove 41, and a passage 63 in which a pressurized fluid passes is connected to the hydraulic groove 43. Also, a second seal ring 64 is installed in the third groove 44.

The first and second sear rings 61 and 62 formed of a base metal guide the piston formed of a metal to be stably elevated without contacting the cylinder 40' formed of a metal. In particular, the second seal ring 64 moves the fluid of the third groove 44 to the hydraulic groove 43, and the first seal ring 62 prevents the fluid passing between the cylinder 40' and the piston 60 from leaking outward. The wiper 61 prevents external foreign material from entering between the piston 60 and the cylinder 40'.

Figure 5:
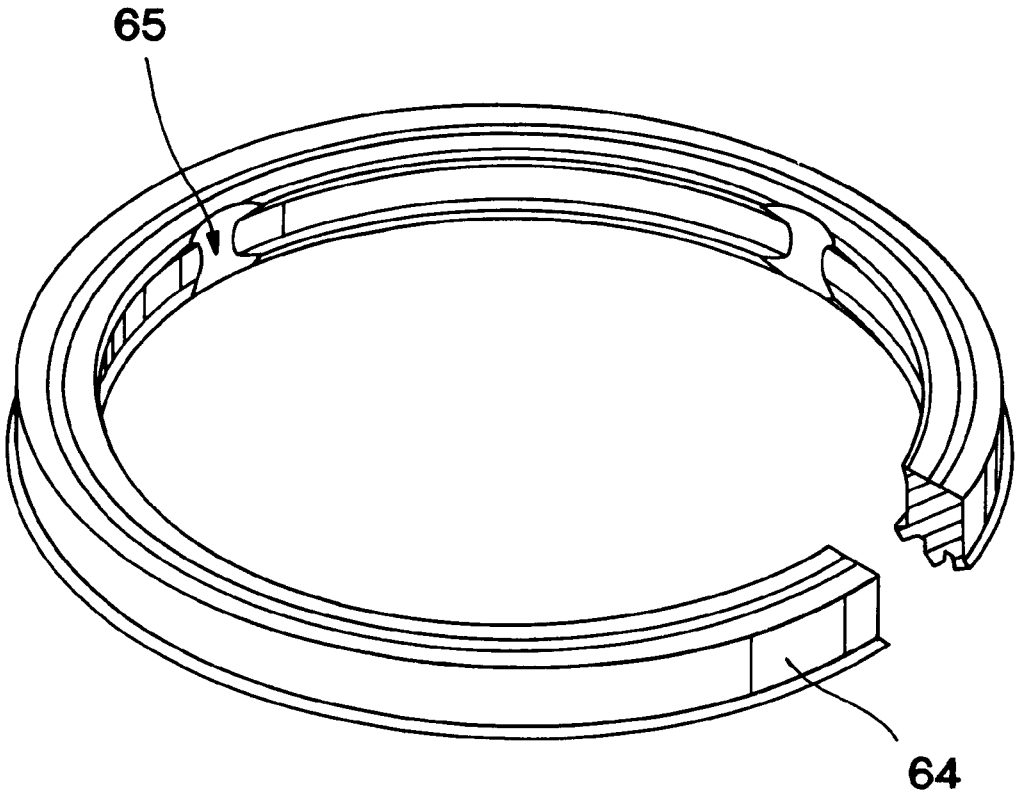
FIG. 5 is a perspective view of the second seal ring of FIG. 4.

FIG. 5 is a perspective view of the second seal ring 64. Grooves 65 are formed on the second seal ring 64. Thus, as shown in FIG. 4, the fluid of the third groove 44 can move downward from the third groove 44.

According to the present invention, two or more seal rings are required to increase the life of the seal ring 62 and suppress damage to the device, and the groove 65 where the fluid passes is formed on the second seal ring 64.

The life of the first and second seal rings is twice as long that of the conventional seal ring.

Referring to FIGS. 3 and 4, high pressure oil in the accumulator 10 and oil of a high pressure hydraulic pump (not shown) are supplied to upper and lower portions of the piston 60 through a passage 63 and the piston 60 is lowered at a high speed according to the difference in section areas between the piston 60 to forcibly move the tool 51. Here, a forceful impact and vibration occurs in the piston 60. The first and second seal rings 62 and 64 absorb the impact and vibration, and stably guide and raise the piston 60. Accordingly, the piston 60 is prevented from directly contacting an inner wall of the cylinder 40', scratching is suppressed on the inner wall of the cylinder 40' and the device is prevented from being damaged.

If there is no groove in the second seal ring 64, the passage for passing the fluid is interrupted.

Figure 6:
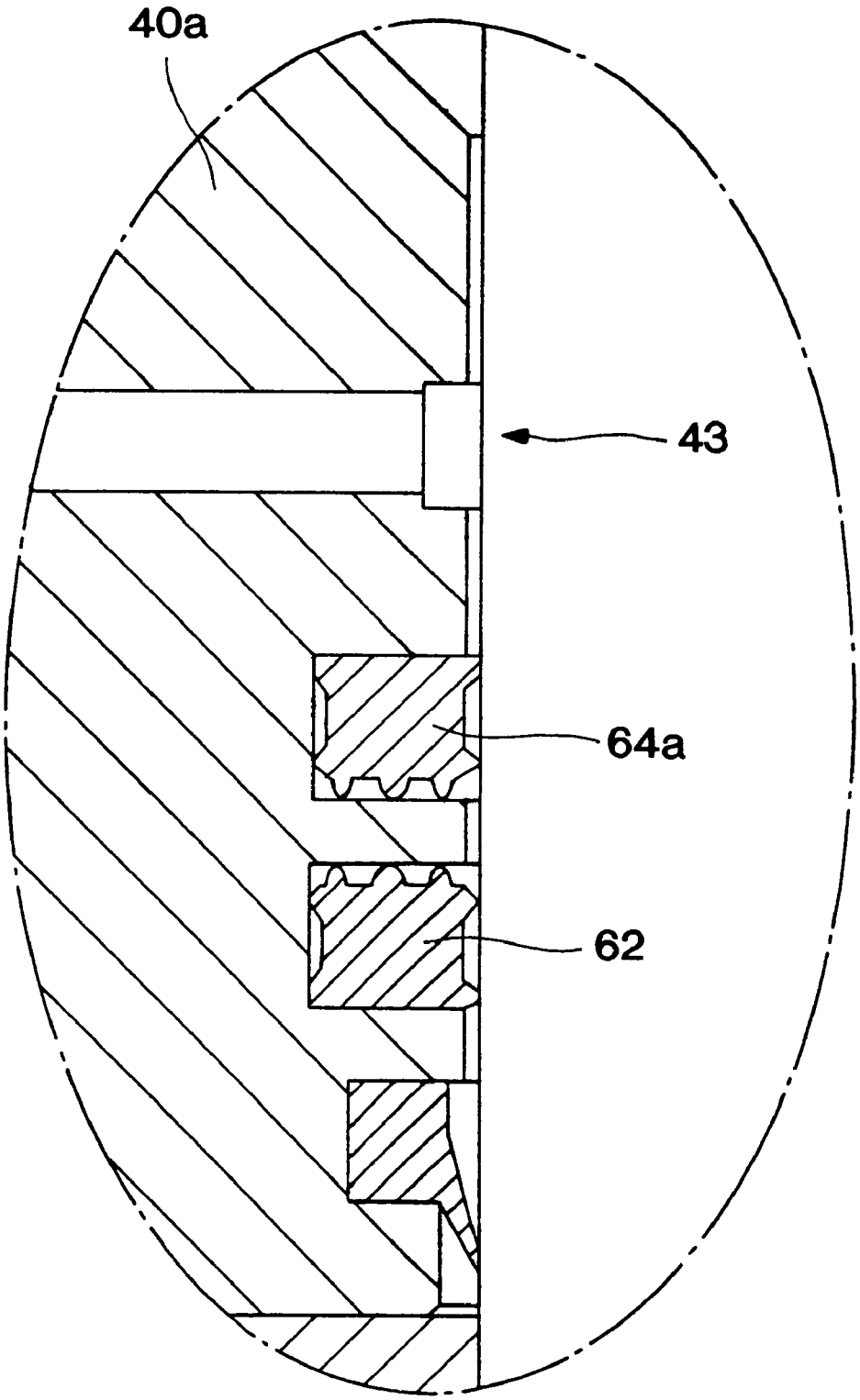
FIG. 6 is an enlarged sectional view of the second seal ring of FIG. 5 disposed between a first seal ring and a fluid groove.

The second seal ring 64 installed in the cylinder 40' of the third groove 44 in the preferred embodiment, may be installed in an inner surface of the cylinder 40' between the third groove 44 and the first seal ring 62 as shown in FIG. 6. Also, the fluid can move through a hole (not shown) instead of the groove 65 formed on the second seal ring 64.

According to the hydraulic hammer of the present invention having an improved seal ring, the life of the seal ring disposed between the piston and the cylinder can be extended, to thereby increase length of use of the seal ring between replacements.

What is claimed is:

1. A hydraulic hammer including a piston-receiving cylinder having an upper an upper and a lower portion, an inner surface, and an outer surface, a movable piston installed within the cylinder for upward and downward movement, said cylinder including a passage formed in said lower portion between said inner and outer surfaces for passing a pressurized fluid therethrough, said cylinder including a longitudinally arranged hydraulic groove in fluid communication with said passage, said hydraulic groove formed in said inner surface so as to be in fluid communication with said passage, said hydraulic groove defined by an upper and lower portion extending respectively above and below said passage by an equal extent, said lower portion having a distal, first groove radially cut into said cylinder and a second groove radially cut into said cylinder, said second groove disposed between said passage and said first groove, said upper portion of said hydraulic groove having a third groove radially cut into said cylinder, the improvement comprising:

a sealing system comprising a wiper disposed within said first groove for preventing dirt from entering between said piston and cylinder;

a first seal ring disposed within said second groove; and a second seal ring disposed within said third groove, each of said seal rings for guiding said piston during movement, thereby preventing piston contact against said inner surface of said cylinder, said second seal ring for moving fluid from said passage into said hydraulic groove during movement of said piston.

2. The hydraulic hammer to claim 1, wherein the second seal ring has at least one fluid groove formed therein, said at least one fluid groove facilitating fluid movement between the third groove and said hydraulic groove upon piston movement.

3. The hydraulic hammer of claim 2 wherein the first seal ring prevents fluid leakage between the inner surface of the cylinder and the piston.

* * * * *